US005738235A

United States Patent [19]

Johnsen

[11] Patent Number: 5,738,235

[45] Date of Patent: Apr. 14, 1998

[54] TANK FOR VERY COLD FLUIDS, ESPECIALLY LIQUID NATURAL GAS

[75] Inventor: Kåre Rygg Johnsen, Jar, Norway

[73] Assignee: Kvaerner Moss Technology a.s., Lysaker, Norway

[21] Appl. No.: 682,701

[22] PCT Filed: Jan. 25, 1995

[86] PCT No.: PCT/NO95/00019

§ 371 Date: Oct. 11, 1996

§ 102(e) Date: Oct. 11, 1996

[87] PCT Pub. No.: WO95/20519

PCT Pub. Date: Aug. 3, 1995

[30] Foreign Application Priority Data

Jan. 28, 1994 [NO] Norway ..... 940316

[51] Int. Cl.[6] ..... B67B 25/00

[52] U.S. Cl. ..... 220/4.12; 220/565; 220/901

[58] Field of Search ..... 220/4.12, 4.26, 220/565, 567, 901, 4.25

[56] References Cited

U.S. PATENT DOCUMENTS

| | | | |
|---|---|---|---|
| 3,770,158 | 11/1973 | Alleaume | 220/901 X |
| 4,106,423 | 8/1978 | Glasfeld et al. | 220/901 X |
| 4,128,070 | 12/1978 | Shadid et al. | 220/901 X |
| 4,181,235 | 1/1980 | Baysinger | 220/901 X |
| 4,486,988 | 12/1984 | Myers | 220/567 X |

*Primary Examiner*—Steven M. Pollard

*Attorney, Agent, or Firm*—Birch, Stewart, Kolasch & Birch, LLP

[57] ABSTRACT

A tank, especially adopted for use aboard a ship, for transporting liquid natural gas. The tank comprises two substantially identical hemispherical sections which are connected to each other via a cylindrical section. The diameter of the cylindrical section corresponds to the diameter of the spherical sections. The length of the cylindrical section is less than ⅓ of its diameter. Further, the tank meets the standards of a Type B classification according to the regulations of the International Maritime Organization.

20 Claims, 1 Drawing Sheet

TANK FOR VERY COLD FLUIDS, ESPECIALLY LIQUID NATURAL GAS

BACKGROUND OF THE INVENTION

1. Field of the Invention

The invention relates to a tank for very cold fluids, especially liquid natural gas.

2. Description of the Related Art

It is known in the prior art that liquid natural gas, LNG, can be transported in ships in spherical tanks which are supported by means of a cylindrical plate construction or skirt. This skirt is connected to the tank along a horizontally extending great circle and rests on the bottom of the ship.

The spherical tanks are advantageous, particularly because their geometry is simple, which permits an accurate calculation to be made of the stresses which arise in the tank material under different operating conditions.

For spherical tanks it is advantageous for the tank to be supported by means of a skirt which extends around the tank, the skirt causing only small local bending stresses in the tank and permitting practically free thermal movement of the tank. Hull deformations are transferred to the tank to only a minor extent due to the rigidity of the skirt.

It is known in the prior art that relatively small cylindrical tanks for liquid petroleum gas, LPG, with a horizontally extending longitudinal axis can be supported by means of U-shaped cradles.

This kind of support presents difficulties in the case of large tanks, since major local bending stresses can occur in the tank wall in the region of the cradles. Moreover, it is difficult to position the tank correctly against the cradle for all the different load conditions which may occur.

However, the demands made on tanks for carrying LNG are quite different to those for tanks for carrying LPG, and it is not obvious that tanks of a cylindrical shape will be suitable for carrying LNG, even though such tanks are used for LPG. This is not obvious particularly if those tanks which have to transport LNG also have to have a volume which is five times larger than the tanks for LPG.

SUMMARY OF THE INVENTION

When using spherical tanks the volumetric utilization of the ship's cargo hold is low. Thus the object of the invention is to provide a tank for very cold fluids, especially LNG, which enables a greater volume of the ship's cargo hold to be utilized.

Other objects and further scope of applicability of the present invention will become apparant from the detailed description given hereinafter. However, it should be understood that the detailed description and specific examples, while indicating preferred embodiments of the invention, are given by way of illustration only, since various changes and modifications within the spirit and scope of the invention will become apparant to those skilled in the art from this detailed description.

BRIEF DESCRIPTION OF THE DRAWINGS

The present invention will become more fully understood from the detailed description given herebelow and the accompanying drawings which are given by way of illustration only, and thus, are not limitative of the present invention, and wherein.

DETAILED DESCRIPTION OF THE INVENTION

Figure 1:
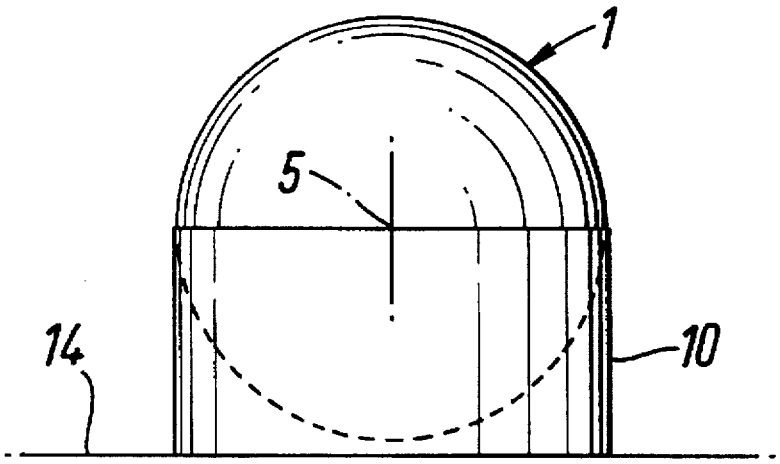
FIG. 1 is a front view of a tank according to the invention.

As illustrated in the figures, a tank 1 according to the invention comprises two hemispherical end pieces 2, 3 which are connected to each other via a cylindrical tank section 4 with the same diameter as the end pieces 2, 3. The tank is therefore rotationally symmetrical about a horizontally extending axis 5 which, when the tank is installed in the ship, normally extends in its longitudinal direction. The tank diameter is usually between 30 m and 45 m.

The cylinder section of cylindrical tanks normally requires a considerably greater wall thickness than the end pieces of the tanks. Surprisingly, however, it has been shown that if the length of the cylindrical section is less than approximately ⅓ of its diameter, it can have a wall thickness which is substantially less than the wall thickness of tanks with long cylindrical sections.

The improved volumetric efficiency which is obtained with tanks designed in this manner compared to tanks of a purely spherical shape is of great importance for operating economy. A tank, according to the present invention, can obtain a "Type B" classification according to the regulations of the International Maritime Organization. Tanks with this classification are of particular interest to the industry. Moreover, it is surprising that a tank with a cylindrical section with reduced wall thickness, as stated above, can obtain such a classification.

The tank is supported by a skirt 10 which can extend continuously around the tank 1. The upper section 12 of the skirt is connected to the tank 1 near the line of intersection between the tank and a horizontal plane 11 which comprises the tank's axis of symmetry 5, and the skirt's longitudinal axis extends vertically downwards. At the upper skirt section 12, there extend plate sections approximately tangentially in relation to the adjacent tank sections. The skirt's lower section 13 rests on a base deck, the ship's bottom 14 or the like. The sides of the skirt also extend vertically.

The skirt can comprise vertical and/or horizontal stiffening elements and include cut-outs in order to achieve an optimum weight/strength ratio. Since the curved sections of the skirt 10 carry more than the straight sections, the skirt's straight section at the cylindrical tank section 4 can be stiffened, thus correspondingly relieving the pressure on the curved sections at the end pieces 2, 3.

Figure 2:
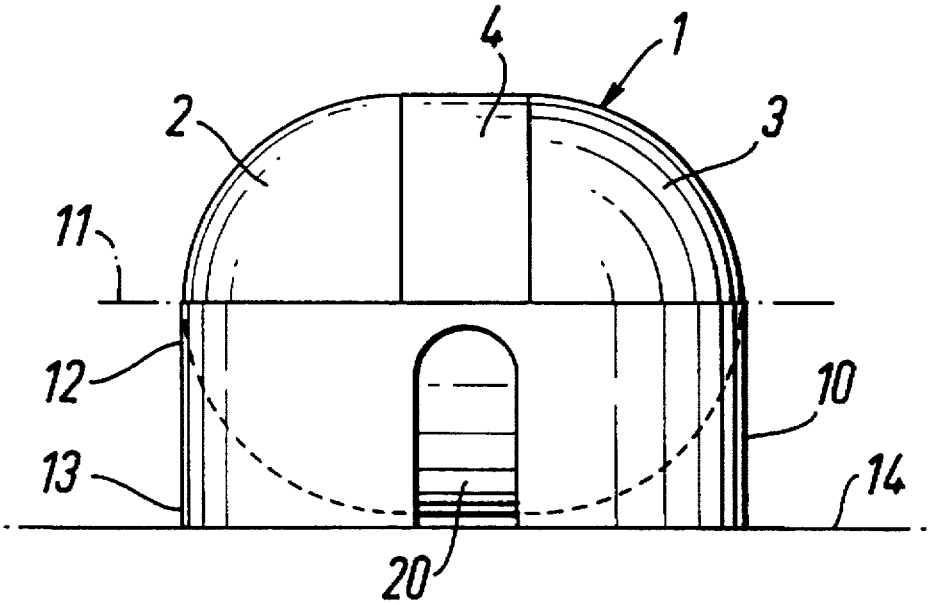
FIG. 2 is a side view of the tank which is shown in FIG. 1.

Alternatively the straight section of the skirt 10 can have a cut-out 20 as illustrated in FIG. 2, since this straight section, with little buckling strength under any circumstances, is capable of bearing only a small proportion of the tank's weight.

Instead of the skirt's upper section 12 being connected to the tank at the above-mentioned line of intersection and the skirt's side extending vertically, the skirt's upper section can be connected to the tank 1 along a line of intersection between the tank and a horizontal plane under the tank's axis of symmetry and the skirt can extend tapered downwardly. This arrangement is advantageous, since it enables the plate areas near the upper skirt edge to also extend tangentially in relation to adjacent tank areas.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A tank assembly includes a tank for very cold fluids, and a skirt supporting said tank, said tank assembly comprising:

a skirt having an approximately central vertical axis a first hemispherical section;

a second hemispherical section which is substantially identical to said first hemispherical section; and a cylindrical section, having an approximately central horizontal axis, connecting said first and second hemispherical sections to form said tank;

wherein said skirt supports said tank by engaging at least said first and second hemispherical sections.

2. A tank assembly according to claim 1 wherein:

said cylindrical section has a diameter and a length, and said length is less than ⅓ of said diameter.

3. A tank assembly according to claim 2 wherein:

said skirt is capable of resting on a base of a ship and said length of said cylindrical section is arranged substantially parallel to the base of the ship when said tank is supported by said skirt.

4. A tank assembly according to claim 2 wherein:

said diameter is between 30 meters and 45 meters.

5. A tank assembly according to claim 1 wherein:

said skirt engages said tank along a plane of symmetry of said tank, the plane of symmetry being defined as a plane which bisects said tank so as to define mirror images of the bisected tank on opposite sides of the plane.

6. A tank assembly according to claim 5 wherein:

said skirt extends substantially tangential to the plane of symmetry.

7. A tank assembly according to claim 1 wherein:

said skirt engages said tank below a plane of symmetry of said tank, the plane of symmetry being defined as a plane which bisects said tank so as to define mirror images of the bisected tank on opposite sides of the plane.

8. A tank assembly according to claim 7 wherein:

said skirt extends at an angle relative to the plane of symmetry.

9. A tank assembly according to claim 1 wherein:

said skirt includes plate sections along an edge of said skirt which engages said tank, said plate sections extending tangentially in relation to an engaged adjacent outer surface of said tank.

10. A tank assembly according to claim 1 wherein:

said tank meets the standards of a Type B classification according to the regulations of the International Maritime Organization.

11. A tank assembly according to claim 1 wherein:

said skirt extends continuously around said tank.

12. A tank assembly includes a tank for very cold fluids, said tank meeting the standards of a Type B classification according to the regulations of the International Maritime Organization, and a skirt supporting said tank, said tank assembly comprising:

a skirt having an approximately central vertical axis a first hemispherical section;

a second hemispherical section which is substantially identical to said first hemispherical section; and a cylindrical section, having an approximately central horizontal axis, connecting said first and second hemispherical sections to form said tank, said cylindrical section having a diameter between 30 meters and 45 meters and a length, and said length being less than ⅓ of said diameter;

wherein said skirt supports said tank by engaging at least said first and second hemispherical sections, and said skirt is capable of resting on a base of a ship and said length of said cylindrical section is arranged substantially parallel to the base of the ship when said tank is supported by said skirt.

13. A tank assembly according to claim 12 wherein:

said skirt engages said tank along a plane of symmetry of said tank, the plane of symmetry being defined as a plane which bisects said tank so as to define mirror images of the bisected tank on opposite sides of the plane.

14. A tank assembly according to claim 13 wherein:

said skirt extends substantially tangential to the plane of symmetry.

15. A tank assembly according to claim 12 wherein:

said skirt engages said tank below a plane of symmetry of said tank, the plane of symmetry being defined as a plane which bisects said tank so as to define mirror images of the bisected tank on opposite sides of the plane.

16. A tank assembly according to claim 15 wherein:

said skirt extends at an angle relative to the plane of symmetry.

17. A tank assembly according to claim 12 wherein:

said skirt includes plate sections along an edge of said skirt which engages said tank, said plate sections extending tangentially in relation to an engaged adjacent outer surface of said tank.

18. A tank assembly according to claim 12 wherein:

said skirt extends continuously around said tank.

19. A tank assembly includes a tank for very cold fluids, and a skirt supporting said tank, said tank assembly comprising:

a skirt having an approximately central vertical axis a first hemispherical section;

a second hemispherical section; and a cylindrical section, having an approximately central horizontal axis, connecting said first and second hemispherical sections to form said tank, said cylindrical section having a diameter and a length;

wherein said skirt supports said tank, and said skirt is capable of resting on a base of a ship and said length of said cylindrical section is arranged substantially parallel to the base of the ship when said tank is supported by said skirt.

20. A tank assembly according to claim 19 wherein:

said diameter is between 30 meters and 45 meters and said length is less than ⅓ of said diameter and said tank meets the standards of a Type B classification according to the regulations of the International Maritime Organization.

* * * * *